US006932509B2

(12) United States Patent
Shah et al.

(10) Patent No.: US 6,932,509 B2
(45) Date of Patent: Aug. 23, 2005

(54) RECLOSEABLE STORAGE BAG WITH SECONDARY CLOSURE MEMBERS

(75) Inventors: Ketan N. Shah, Gurnee, IL (US); Kenneth S. Nurkiewicz, Racine, WI (US); Peggy B. Winiarski, Franksville, WI (US)

(73) Assignee: S. C. Johnson Home Storage, Inc., Racine, WI (US)

( * ) Notice: Subject to any disclaimer, the term of this patent is extended or adjusted under 35 U.S.C. 154(b) by 183 days.

(21) Appl. No.: 10/184,726

(22) Filed: Jun. 28, 2002

(65) Prior Publication Data

US 2004/0000501 A1 Jan. 1, 2004

(51) Int. Cl.[7] ..... B65D 33/01
(52) U.S. Cl. ..... 383/103; 383/63; 383/66
(58) Field of Search ..... 383/63, 66, 100, 383/103, 42, 10, 15

(56) References Cited

U.S. PATENT DOCUMENTS

| | | | | |
|---|---|---|---|---|
| 3,937,396 | A | | 2/1976 | Schneider |
| 4,310,118 | A | | 1/1982 | Kisida et al. |
| 5,142,970 | A | * | 9/1992 | ErkenBrack ..... 99/472 |
| 5,240,112 | A | | 8/1993 | Newberger |
| 5,407,087 | A | | 4/1995 | Giblin et al. |
| 5,450,963 | A | | 9/1995 | Carson |
| 5,480,030 | A | | 1/1996 | Sweeney et al. |
| 5,492,241 | A | | 2/1996 | Barnett et al. |
| 5,523,236 | A | | 6/1996 | Nuzzo |
| 5,584,409 | A | | 12/1996 | Chemberlen |
| 5,587,192 | A | | 12/1996 | Beizermann |
| 5,692,837 | A | | 12/1997 | Beer |
| 5,829,884 | A | | 11/1998 | Yeager |
| 5,839,582 | A | | 11/1998 | Strong et al. |
| 5,881,881 | A | | 3/1999 | Carrington |
| 5,894,929 | A | * | 4/1999 | Kai et al. ..... 206/524.8 |
| 5,988,426 | A | | 11/1999 | Stern |
| 5,996,800 | A | | 12/1999 | Pratt |
| 6,039,182 | A | | 3/2000 | Light |
| 6,056,439 | A | | 5/2000 | Graham |
| 6,059,457 | A | | 5/2000 | Sprehe et al. |
| 6,070,397 | A | | 6/2000 | Bachhuber |
| 6,070,728 | A | | 6/2000 | Overby et al. |
| 6,076,967 | A | | 6/2000 | Beaudette |
| 6,132,089 | A | | 10/2000 | Galomb et al. |
| 6,149,304 | A | | 11/2000 | Hamilton et al. |
| 6,194,011 | B1 | | 2/2001 | Glaser |
| 6,231,236 | B1 | | 5/2001 | Tilman |
| 6,274,181 | B1 | | 8/2001 | Richison et al. |
| 6,357,915 | B2 | | 3/2002 | Anderson |
| 6,378,272 | B1 | | 4/2002 | Archibald et al. |
| 6,408,872 | B1 | | 6/2002 | Skeens et al. |
| 6,575,191 | B2 | | 6/2003 | Skeens et al. |

(Continued)

FOREIGN PATENT DOCUMENTS

| | | |
|---|---|---|
| DE | 198 43 430 A1 | 3/2000 |
| EP | 0 729 901 A1 | 4/1996 |
| JP | 03212355 | 9/1991 |
| JP | 8198274 | 8/1996 |

OTHER PUBLICATIONS

International Search Report for Application No. PCT/US03/20478; report dated Oct. 1, 2003.
International Search Report for Application No. PCT/US03/20594 mailed Jul. 21, 2004.

*Primary Examiner*—Jes F. Pascua

(57) ABSTRACT

A recloseable storage bag is disclosed which may include first and second sides having closed sides and an open top. Primary closure members may be provided proximate the top, with secondary closure elements being provided around an aperture in at least one of the sides to enable gas to be evacuated from the bag after the primary closure members are closed.

7 Claims, 5 Drawing Sheets

U.S. PATENT DOCUMENTS

| | | | |
|---|---|---|---|
| 6,604,634 | B2 | 8/2003 | Su |
| 6,634,384 | B2 | 10/2003 | Skeens et al. |
| 6,692,147 | B2 | 2/2004 | Nelson |
| 6,729,473 | B2 | 5/2004 | Anderson |
| 2002/0043052 | A1 | 4/2002 | Gyorffy |
| 2003/0066267 | A1 | 4/2003 | Nelson |
| 2004/0007494 | A1 | 1/2004 | Popeil et al. |
| 2004/0057636 | A1 | 3/2004 | Ishizaki |

* cited by examiner

RECLOSEABLE STORAGE BAG WITH SECONDARY CLOSURE MEMBERS

FIELD OF THE DISCLOSURE

The present disclosure relates to recloseable storage bags. More particularly, the present disclosure relates to recloseable storage bags having valves for evacuating air through an aperture in the bag.

BACKGROUND OF THE DISCLOSURE

Recloseable storage bags are well known, especially with regard to food storage. The bags are generally made out of a plastic film and have two side walls which are sealed around the edges. Such material is fluid impermeable, relatively inexpensive, and can be manufactured in transparent form thereby facilitating content identification. Accordingly, plastic bags have become the dominant product of choice in the area of food storage bags.

Such bags are typically recloseable and substantially sealable. One common approach to provide such features employs closure members at a top edge of a bag having first and second thermoplastic layers folded or heat sealed along bottom and first and second side edges. The closure members may be provided in the form of mating male and female profiles such as those provided by the present assignee under the ZIPLOC® trademark. The male and female profiles are also typically manufactured from plastic, with the male profile including a linear tab adapted to be interlocked with a linear groove of the female profile.

The male and female profiles can be connected to close the bag by pinching and pulling across the closure members along the length of the top edges. Such motion can be accomplished with the thumb and forefinger of a user or through the use of a sliding element mounted to the male and female profiles, as is the case with bags provided by the present assignee under the ZIPLOC® trademark as well.

While such bags have been met with extraordinary commercial success from their inception until the present day, the assignee continues to improve its product offerings. One area, which the assignee has identified as grounds for improvement, involves the ability to evacuate air from a bag. While the primary closure found at the top of many plastic bags provides an airtight seal and thus facilitates preservation of contents, air remaining enclosed in the bag after closure enables bacterial growth and therefore hinders the preservation and freshness the bags are intended to maintain.

It would be an advance in the art of bags to provide a bag with an aperture, for evacuating air, and a secondary closure means, or valve, for sealing the aperture. In this manner, a bag may be closed at the top using the primary means of closure, as described above, and subsequently evacuated of air by compressing the bag and subsequently sealing the secondary means of closure, or valve, around an aperture.

SUMMARY OF THE DISCLOSURE

In accordance with one aspect of the disclosure, a storage bag is disclosed which comprises a first and second side attached at the left, bottom, and right edges. Disposed in the top edges are primary closure members for substantially sealing the bag. Also disposed in at least one of the first and second sides is an aperture surrounded by a secondary closure means for substantially sealing the aperture.

In accordance with another aspect of the disclosure, a method of evacuating air from a recloseable storage bag which comprises the steps of sealing the primary closure members of a bag having a first and second side, attached at the left, bottom, and top edges; opening a valve associated with an aperture in the bag; compressing the bag so as to evacuate excess air through the aperture; and reengaging the valve members to form a seal around the aperture. The method of evacuating air from the bag employs at least one aperture in the bag though which excess air can escape upon compression of the bag and secondary closure elements, or valve members, for sealing the aperture.

In accordance with yet another aspect of the disclosure, a storage bag is disclosed which comprises a first and second side attached at the left, bottom, and right edges, having a primary closure means proximate the top edges, and means for evacuating air from the bag after the primary closure members are sealed, the means including at least one aperture surrounded by first and second closure elements.

These and other aspects and features of the disclosure will become more apparent from the following detailed description when taken in conjunction with the accompanying drawings.

Figure 1:
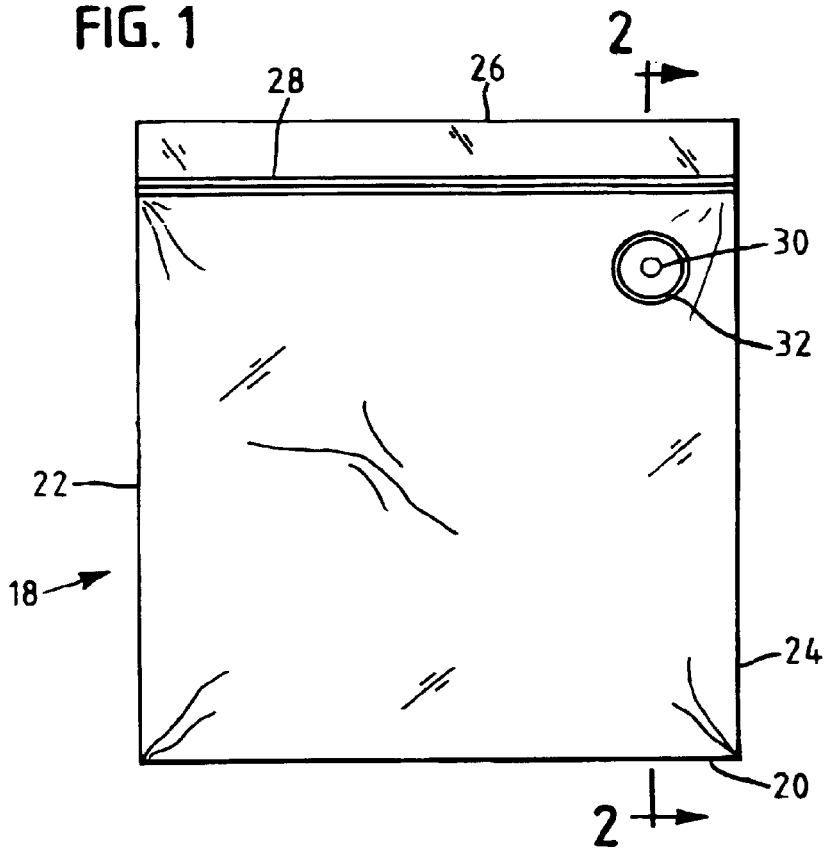
FIG. 1 is a front view of a bag constructed in accordance with the disclosure and depicted in a closed state.

While the disclosure is susceptible to various modifications and alternative constructions, certain illustrative embodiments thereof have been shown in the drawings and will be described below in detail. It should be understood, however, that there is no intention to limit the disclosure to the specific forms disclosed, but on the contrary, the intention is to cover all modifications, alternative constructions, and equivalents falling within the spirit and scope of the invention as defined by the appended claims.

DETAILED DESCRIPTION OF THE DISCLOSURE

Figure 2:
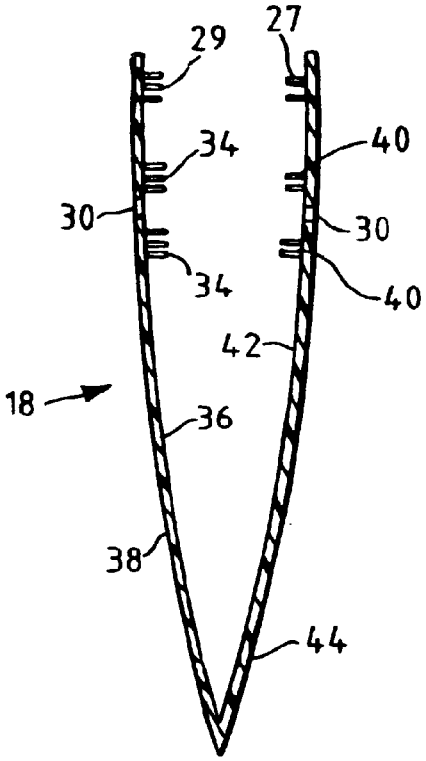
FIG. 2 is a sectional view of FIG. 1 taken along line 2—2 of FIG. 1, with the primary and secondary closures depicted in an open state.

Referring now to the drawings, and with specific reference to FIG. 1, a recloseable storage bag constructed in accordance with the present disclosure is generally referred to by reference numeral 18. FIG. 1 illustrates a front view of the bag 18 in a closed position while FIG. 2 illustrates a sectional view of the bag 18 along line 2—2 of FIG. 1 in an open position. While the recloseable storage bag is depicted to have a substantially rectangular configuration, it is to be understood that the teachings of the invention can be employed with equal efficacy to bags having alternative shapes including, but not limited to, circular, cylindrical, trapezoidal, or polygonal shapes. Moreover, while the bag 18 will be described herein with predominant reference to food storage bags, such as those sold by the assignee under its ZIPLOC® trademark, it is to be understood that the teachings of the disclosure could be employed in any other type of bag, such as, but not limited to, bags used to store perishable goods other than food, as well as bags which are not intended to be recloseable.

Referring now to FIGS. 1 and 2, the bag 18 is depicted to include a first side 38 and a second side 44, each of which are joined at their left edge 22, bottom edge 20, and right edge 24. Each side 38, 44 also has a top edge 26 with a primary closure device 28 across the top edge 26. In the depicted embodiment, the left edges 22, the bottom edges 20, and right edges 24 are connected by heat seal, but it is to be understood that heat seals, folds, or any other type of joinder can be employed at any of the edges 22, 20, or 24. As shown in FIG. 2, the primary closure device 28 may include a male profile strip 27 and a female profile strip 29 adapted to interlock to close the bag 18 at the top edges 26. In the depicted embodiment, the male profile strip 27 is bonded to the inner surface 42 of the second side 44, while the female profile strip 29 is bonded to the inner surface 36 of the first side 38, but it is to be understood that alternative forms of closure devices including, but not limited to, adhesives, tongue and loop fasteners, invertable folds, buttons, clips, and the like may be utilized. In alternative forms of male and female profiles, the male profile may include only one tab and groove combination, or more than two linear tabs, with the mating female profile having a corresponding number of grooves. As will be readily understood by one of ordinary skill in the art, the primary closure members 27, 29 can be joined using a pinch-and-seal motion with the thumb and forefinger. Such pressure causes the members 27, 29 to frictionally intermesh in alternating fashion, thereby substantially sealing the bag. A slider or the like can also be provided to facilitate such zipper action.

In this manner, the bag 18 is constructed to have an interior storage space accessible between the top edges 26 when the primary closure members 27, 29 are open. After the primary closure members 27, 29 are closed, the bag 18 is substantially sealed. In order to remove excess gas, such as air, from the interior storage space, an aperture 30 may be provided in one or more of the sides 38, 44. In this manner, gas can be forced out of the storage space by compressing the bag 18, or otherwise manipulating the bag 18, to force excess air from the space to the atmosphere through the aperture 30.

Figure 3:
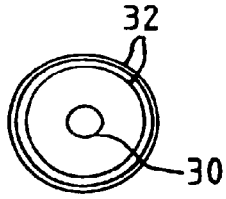
FIG. 3 is an enlarged top view of the secondary closure element depicted in FIG. 1.

FIGS. 1 and 2 further illustrate the bag 18 as having secondary closure elements 32 surrounding the aperture 30 constructed in accordance with the present disclosure. As shown in FIG. 2, the aperture 30 is present in the first and second sides 38, 44 of the bag 18. Surrounding the aperture on both the first and second sides 38, 44 are secondary closure elements 32. In the depicted embodiment, the secondary closure elements 32 include a female closure member 34 positioned around the aperture 30 on the inner surface 36 of the first side 38 and a male closure member 40 positioned around the aperture 30 on the inner surface 42 of the second side 44. In addition, an enlarged front view of the secondary closure elements and aperture, as depicted in FIG. 1, can be seen in FIG. 3 and further demonstrates the position of the secondary closure elements 32 as surrounding the aperture 30. As with the primary closure 28, alternate forms of the secondary closure elements 32 may include male and female profiles, the male profile may having only one tab and groove combination, or more than two linear tabs, with the mating female profile having the corresponding number of grooves. Moreover, the male and female strips 27, 29 may be bonded to the inner surface 42 of the second side 44 and the inner surface 36 of the first side 38, respectively, in a variety of manners including, but not limited to, coextrusion, adhesion, ultrasonic welding, lamination, or the like.

This mechanism for sealing the aperture 30 operates in a pinch-and-seal manner like that described above for the primary closure elements 27, 29 and thus, substantially seals the aperture 30. Accordingly, upon evacuation of excess gas from the bag 18 through the aperture 30, the aperture 30 may be sealed using the secondary closure members 34, 40 to keep air from reentering the bag 18.

Figure 4:
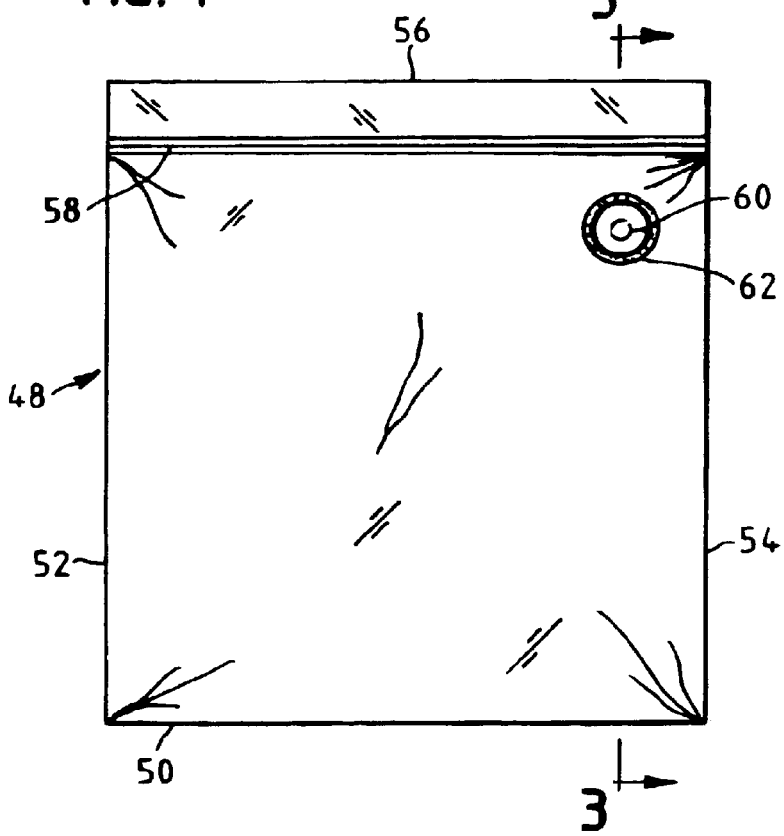
FIG. 4 is a front view of an alternative embodiment of a bag constructed in accordance with the teachings of the disclosure, with the bag depicted in a closed state.
Figure 5:
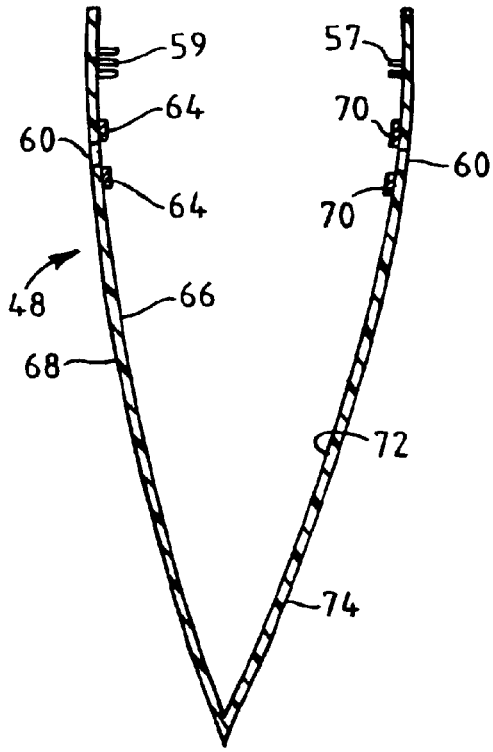
FIG. 5 is a sectional view of FIG. 1 taken along line 3—3 of FIG. 4, with the primary and secondary closures depicted in an open state.

Referring now to FIGS. 4 and 5 a recloseable storage bag constructed in accordance with the present disclosure is generally referred to by reference numeral 48. FIG. 4 illustrates a front view of the bag 48 in a closed position while FIG. 5 illustrates a sectional view of the bag 48 along line 3—3 of FIG. 4 in an open position. Like the bag 18 illustrated in FIGS. 1 and 2, the bag 48 illustrated in FIGS. 4 and 5 is depicted to include a first side 68 and a second side 64, each of which are joined at their left edge 52, bottom edge 50, and right edge 54. Each side 68, 74 also has a top edge 56 with a primary closure device 58 across the top edge 56. In the depicted embodiment, the left edges 52, the bottom edges 50, and right edges 54 are connected by heat seals, but it is to be understood that heat seals, folds, or any other type of joinder can be employed at any of the edges 52, 50, or 54. As shown in FIG. 5, the primary closure device 58 may include a male profile strip 57 and a female profile strip 59 adapted to interlock to close the bag 48 at the top edges 56. In the depicted embodiment, the male profile strip 57 is bonded to the inner surface 72 of the second side 74, while the female profile strip 59 is bonded to the inner surface 66 of the first side 68, but it is to be understood that alternative forms of closure devices may be utilized.

FIGS. 4 and 5 further illustrate the bag 48 as having secondary closure elements 62 surrounding an aperture 60 constructed in accordance with the present disclosure. As shown in FIG. 5, an aperture 60 is present in the first and second sides 68, 74 of the bag 48. Surrounding the aperture on both the first and second sides 68, 74 are secondary closure elements 63. In the depicted embodiment, the secondary closure elements 62 include an adhesive material 64 positioned around the aperture 60 on the inner surface 66 of the first side 68 and an adhesive material 70 positioned around the aperture 60 on the inner surface 72 of the second side 74. The secondary closure elements 62 may include alternative forms of closure devices including, but not limited to, hook and loop fasteners. In addition, the secondary closure elements may be bonded to the inner surface 72 of the second side 74 and the inner surface 66 of the first side 68, respectively, in a variety of manners.

Figure 6:
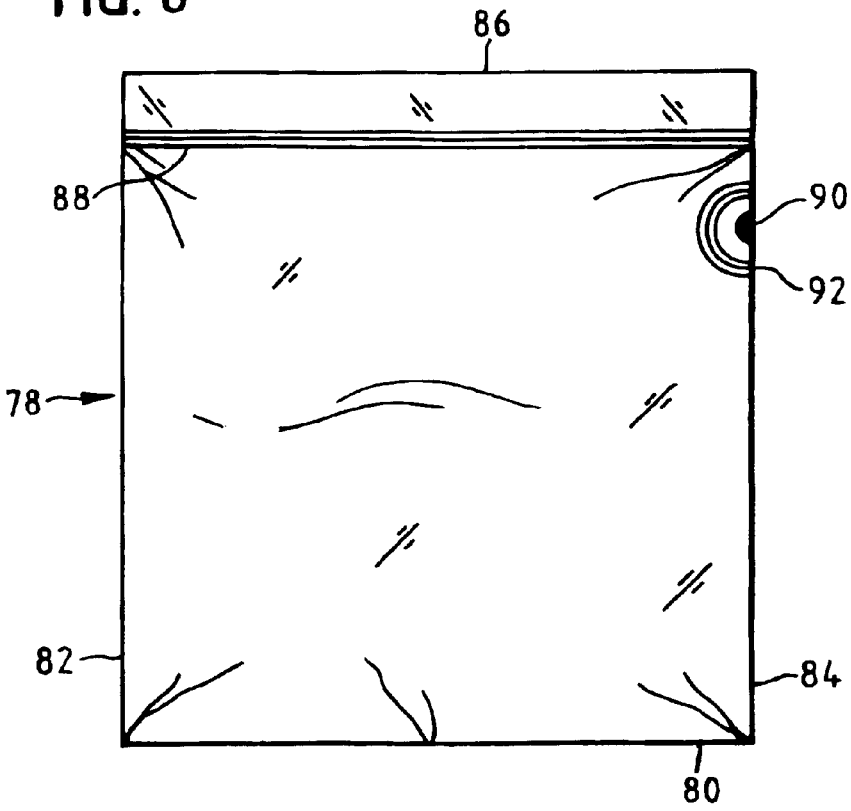
FIG. 6 is front view of an alternative embodiment of a bag constructed in accordance with the teachings of the disclosure, with the bag depicted in a closed state.
Figure 7:
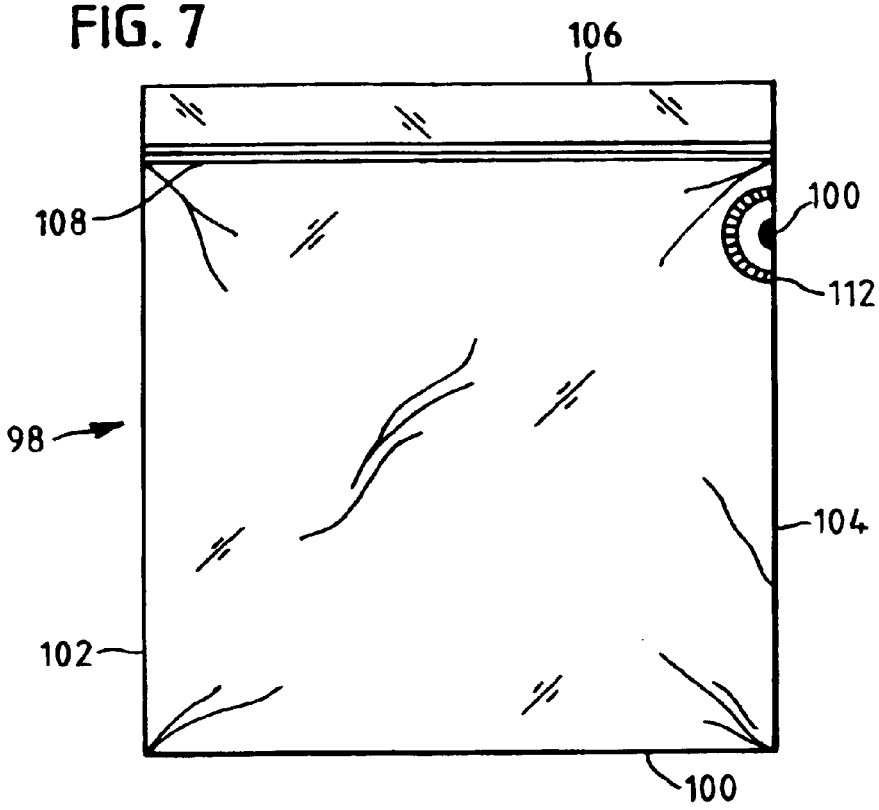
FIG. 7 is front view of an alternative embodiment of a bag constructed in accordance with the teachings of the disclosure, with the bag depicted in a closed state.

Referring now to FIGS. 6 and 7, recloseable storage bags constructed in accordance with the present disclosure are illustrated and generally referred to by reference numerals 78 and 98. FIGS. 6 and 7 illustrate front views of the bags 78, 98 in closed positions. As depicted, the bags 78, 98 include a left edge 82, 102, a bottom edge 80, 100, and a right edge 84, 104. In both bags 78, 98 the top edge 86, 106 is provided with a primary closure device 88, 108 as described above for the bags illustrated by FIGS. 1–4. Alternate forms of primary closure devices may be utilized and are described with respect to FIGS. 1–4. The embodiments depicted as bags 78 and 98 are constructed with the apertures 90, 110 positioned on the right edge 84, 104 of the bags 78, 98. As in the previously described embodiments, the apertures 90, 110 in these bags 78, 98 are through both sides of the bags 78, 98; however, because the apertures 90, 110 are positioned at the edge 84, 104 of the bag 78, 98, the secondary closure elements 92, 102 surrounding the apertures 90, 110 are semi-circular in shape rather than circular in shape.

In most all respects, the bags 78, 98 illustrated by FIGS. 6 and 7 are the same. One difference in the bags 78, 98 concerns their respective secondary closure elements. In FIG. 6 the bag 78 is constructed of a female closure member positioned around the aperture 90 on the inner surface one side of the bag 78 and a male closure member positioned around the aperture 90 on the inner surface of the other side of the bag. These secondary closure elements 92 are therefore analogous to those secondary closure elements 32 described for the bag 18 illustrated in FIGS. 1 and 2. Alternatively, FIG. 7 illustrates a bag 98 constructed to include secondary closure elements 112 having an adhesive material positioned around the aperture on the inner surface of one side and an adhesive material positioned around the aperture 110 on the inner surface of the other side. These secondary closure elements 112 are therefore analogous to those secondary closure elements 62 described for the bag 48 illustrated in FIGS. 4 and 5. The secondary closure elements may include alternative forms of closure devices including, but not limited to, hook and loop fasteners.

Figure 8:
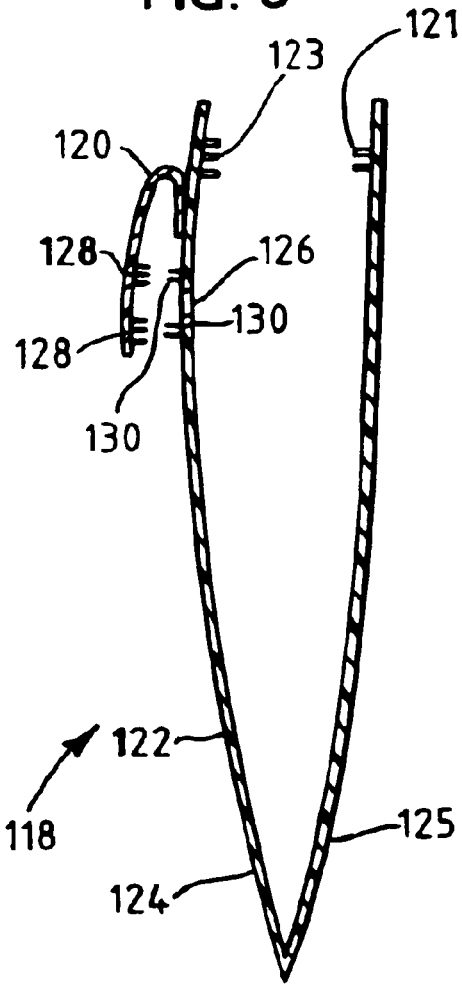
FIG. 8 is a sectional view of an alternative embodiment of a bag constructed in accordance with the teachings of the disclosure, with the primary and secondary closures depicted in an open state.

Referring now to FIG. 8, a recloseable storage bag constructed in accordance with the present disclosure is generally referred to by reference numeral 118. FIG. 8 illustrates a cross-sectional view of the bag 118 in an open position. Like the bags 18 illustrated in FIGS. 1 and 2, the bag 118 illustrated in FIG. 8 includes a first side 124 and a second side 125, each of which are joined at their left edges, bottom edges, and right edges. Each side has top edges provided with a primary closure device across the top edge. The primary closure device may include a male profile strip 121 and a female profile strip 123 adapted to interlock to close the bag 118 at the top edges. In the depicted embodiment, the male profile strip 121 is bonded to the inner surface of the second side 125, while the female profile strip 123 is bonded to the inner surface of the first side 124, but it is to be understood that alternative forms of closure devices may be utilized.

FIG. 8 further illustrates the bag 118 as having a base tab 120 mounted on the outer surface 122 of the first side 124. As illustrated, the base tab 120 is positioned nearby an aperture 126 in the first side 124 of the bag 118 and is adapted with a secondary closure element 128 for sealing the aperture 126. As shown in FIG. 8, the secondary closure elements include a female closure member 128 positioned on the base tab 120 nearby the aperture 126. Positioning of the female closure member 128 is such that it can engage a male closure member 130 positioned around the aperture 126 on the outer surface 122 of the first side 124. This construction, like those described in FIGS. 1–7, provides a seal around the aperture 126. As with the primary closure, alternate forms of the secondary closure elements 128, 130 may be utilized.

Figure 9:
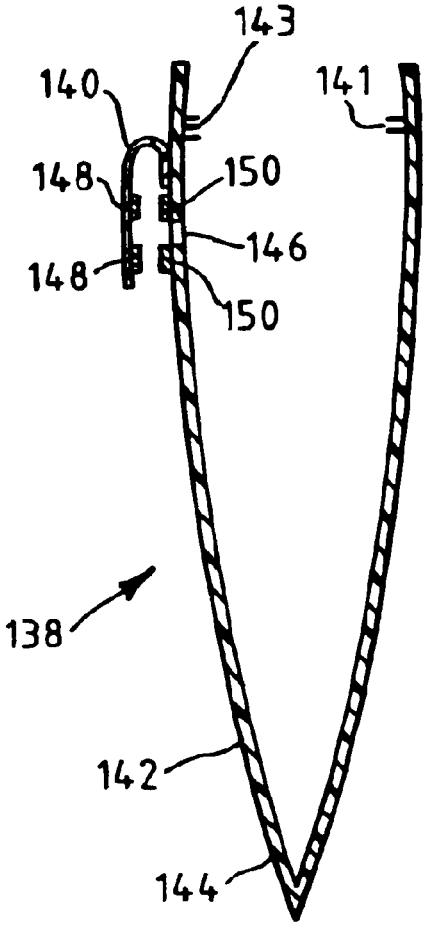
FIG. 9 is a sectional view of an alternative embodiment of a bag constructed in accordance with the teachings of the disclosure, with the primary and secondary closures depicted in an open state.

FIG. 9 illustrates another embodiment of a recloseable storage bag constructed in accordance with the present disclosure and is generally referred to by reference numeral 138. FIG. 9 illustrates a sectional view of the bag 138 in an open position. As in FIG. 8, the bag 138 of FIG. 9 includes a base tab 140 mounted on the outer surface 142 of the first side 144. As depicted, the base tab 140 is positioned nearby an aperture 146 in the first side 144 of the bag 138 and is provided with a secondary closure element 148 for sealing the aperture 146. As shown in FIG. 8, the secondary closure elements include an adhesive material 148 positioned on the base tab 140 nearby the aperture 146. Positioning of this closure member 148 is such that it can engage a corresponding secondary closure member 150 also constructed from an adhesive material and positioned around the aperture 146 on the outer surface 142 of the first side 144. The secondary closure elements 148, 150 may include alternative forms of closure devices including, but not limited to, hook and loop fasteners. This construction, like those described above, provides a seal around the aperture 146.

Figure 10:
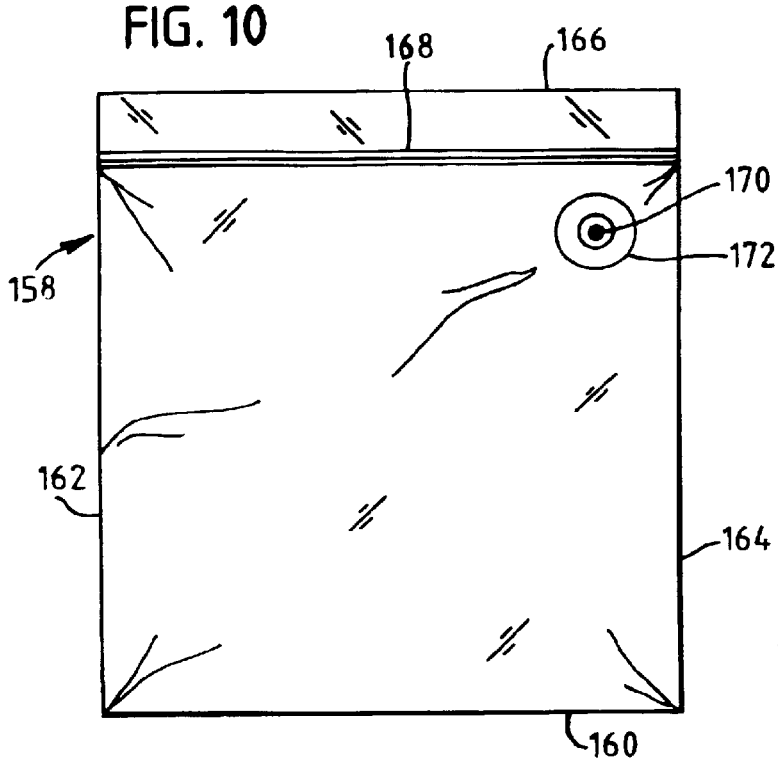
FIG. 10 is a front view of an alternative embodiment of a bag constructed in accordance with the teachings of the disclosure, with the bag depicted in a closed state.

Referring now to FIG. 10, another recloseable storage bag constructed in accordance with the present disclosure is generally referred to by reference numeral 158. FIG. 10 illustrates a front view of the bag 158 in a closed position and having a left edge 162, bottom edge 160, and right edge 164. A top edge 166 includes a primary closure device 168. As described above, the primary closure device 168 may include a male profile strip and a female profile strip adapted to interlock to close the bag 158 at the top edges 166, but it is to be understood that alternative forms of closure devices may be utilized.

Figure 11:
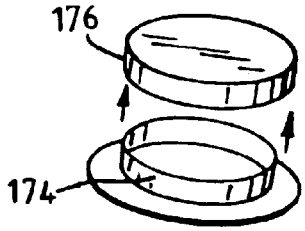
FIG. 11 is an enlarged exploded view of the secondary closure elements depicted in FIG. 10.

FIGS. 10 and 11 further illustrate the secondary closure elements 172 surrounding an aperture 170 constructed in accordance with the present disclosure. The bag 158 is constructed such that the aperture 170 is positioned on the first side of the bag 158. Surrounding the aperture 170 is a stem 174 extending from the aperture 170. Further, a removable cap 176 is provided to connect to the stem 174, in turn, sealing the aperture 170.

Figure 12:
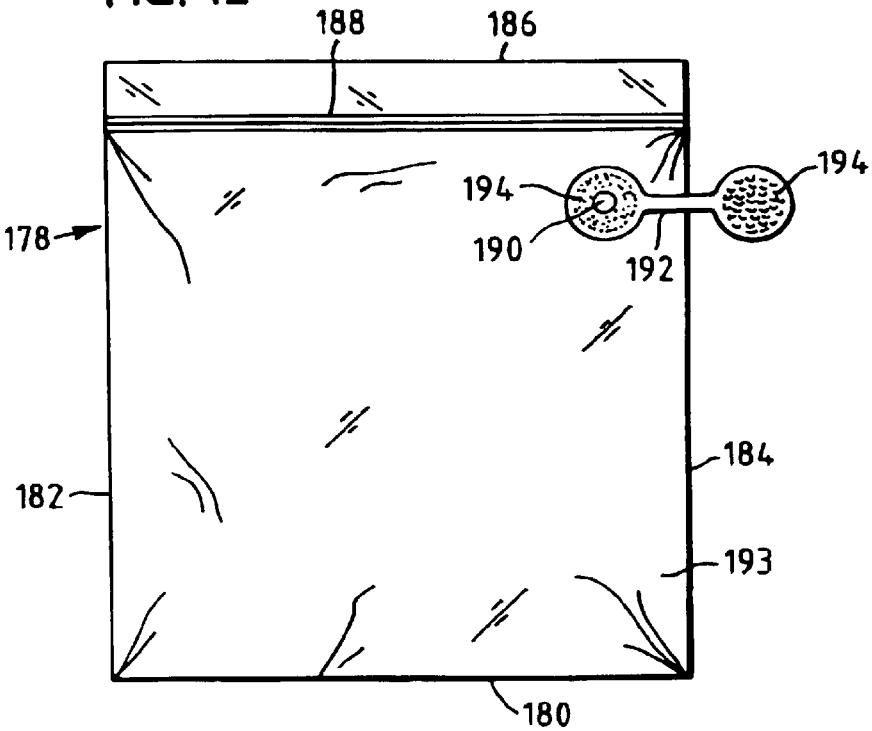
FIG. 12 is a front view of an alternative embodiment of a bag constructed in accordance with the teachings of the disclosure, with the bag depicted in a closed state and the secondary closures depicted in an open state.

Lastly, FIG. 12 illustrates another recloseable storage bag constructed in accordance with the present disclosure and is generally referred to by reference numeral 178. FIG. 12 depicts a front view of the bag 178 having a left edge 182, bottom edge 180, and right edge 184. FIG. 12 further depicts the primary closure members 188 on the top edge 186 in a closed position and the secondary closure members 192 in an open position. As described above, the primary closure device 188 may include a male profile strip and a female profile strip adapted to interlock to close the bag 178 at the top edges 186, but it is to be understood that alternative forms of closure devices may be utilized.

The secondary closure members 192 illustrated in FIG. 12 include a base tab 192 mounted on an outer surface 193 of the first side. As depicted, the base tab 192 is positioned around an aperture 190 in the first side of the bag 178 and is provided with a layer 194 of hook and loop fastener. A movable flap 195 is hinged to the bag 178 at a pivot 197 and includes another layer 199 of hook and loop fasteners. Accordingly, the flap 195 can be folded over to attach the two layers 194, 199 of hook and loop fasteners and thus, close the aperture 190.

The disclosure provides various embodiments of recloseable storage bags having secondary closure elements surrounding an aperture for evacuating excess air from bags. Specifically, after inserting the contents and sealing the primary closure members, the unoccupied interior storage space is compressed, or otherwise manipulated, to force any excess air from the interior space through an aperture in at least one of the sides of the bag. In this manner, the aperture combined with pressure on gasses trapped in the bag creates an airflow passageway through which the excess gas can escape.

Furthermore, the above-described embodiments provide mechanisms for sealing the aperture in a manner such that excess air is prevented from reentering the bag after evacuation. Many of the secondary closure elements provided by this disclosure operate in a pinch-and-seal manner like that described above for the primary closure elements. Specifically, by engaging the female member of the secondary closure elements with the corresponding male closure member, a seal around the aperture is created. Likewise, where an adhesive material is employed for the secondary closure elements, compression of the adhesive members with one another creates a seal around the aperture. Also disclosed is a means for sealing the aperture involving placement of a firm fitting cap over a stem extending from the aperture. By engaging the secondary closure members provided above, the aperture for evacuating excess air is substantially sealed and gasses are prevented from passing into or out of the bag.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A recloseable storage bag, comprising:

a first side having a bottom edge, left edge, right edge, and top edge;

a second side having a bottom edge, left edge, right edge, and top edge, the bottom edges of the first and second sides being attached, the left edges of the first and second sides being attached, and the right edges of the first and second sides being attached;

primary closure members being provided proximate the top edges of the first and second sides;

an aperture in each of the first and second sides; and a first secondary closure member circumferentially surrounding the aperture on an inner surface of the first side and a second secondary closure member surrounding the aperture on an inner surface of the second side, the apertures allowing communication between an interior space of the bag and atmosphere when the first and second secondary closure members are disconnected.

2. The storage bag of claim 1, wherein the first and second secondary closure members include a female closure member for engagement with a male closure member.

3. The storage bag of claim 2, wherein the male and female closure members are circular.

4. A recloseable storage bag, comprising:

a first side having a bottom edge, left edge, right edge, and top edge;

a second side having a bottom edge, left edge, right edge, top edge, and the bottom edges of the first and second sides being attached, the left edges of the first and second sides being attached, and the right edges of the first and second sides being attached;

primary closure members being provided proximate the top edges of the first and second sides; and means for evacuating air from the bag after the primary closure members are sealed, the means for evacuating including an aperture in each of the first and second sides, the apertures circumferentially surrounded by first and second secondary closure members, the secondary closure members positioned on inner surfaces of the first and second sides, the apertures in the first and second sides allowing communication between an interior space of the bag and atmosphere when the first and second secondary closure members are disconnected.

5. The recloseable storage bag of claim 4, wherein the first and second closure members are pinch and seal fasteners.

6. A method of evacuating air from a recloseable storage bag, comprising the steps of:

providing a bag, having first and second sides connected along first and second side edges thereof, the bag further including a top and bottom, the bottom being closed, the top adapted to open and close using primary closure members proximate the top edges of the first and second sides, the bag further including an aperture in each of the first and second sides, a first secondary closure member surrounding the aperture on an inner surface of the first side, and a second secondary closure member circumferentially surrounding the aperture on an inner surface of the second side;

closing the bag using the primary closure members positioned at the top of the sides;

opening the secondary closure members associated with the apertures;

compressing the bag to create an air flow passageway through the apertures; and reengaging the secondary closure members to form a seal.

7. The method of claim 6, wherein the reengaging step involves pinching together male and female closure strips.

* * * * *